US006585800B2

(12) United States Patent
Sugitatsu et al.

(10) Patent No.: US 6,585,800 B2
(45) Date of Patent: Jul. 1, 2003

(54) METHOD FOR MAKING MOLTEN METAL

(75) Inventors: Hiroshi Sugitatsu, Osaka (JP); Hiroshi Uemura, Osaka (JP); Toshiyuki Okumura, Tokyo (JP)

(73) Assignee: Kabushiki Kaisha Kobe Seiko Sho, Kobe (JP)

( * ) Notice: Subject to any disclaimer, the term of this patent is extended or adjusted under 35 U.S.C. 154(b) by 0 days.

(21) Appl. No.: 10/205,401

(22) Filed: Jul. 26, 2002

(65) Prior Publication Data

US 2003/0019329 A1 Jan. 30, 2003

(30) Foreign Application Priority Data

Jul. 27, 2001 (JP) ..... 2001-227791

(51) Int. Cl.[7] ..... C22B 9/00

(52) U.S. Cl. ..... 75/572; 75/572; 75/569; 75/524; 266/275

(58) Field of Search ..... 75/569, 524; 266/275

(56) References Cited

U.S. PATENT DOCUMENTS

| | | | | |
|---|---|---|---|---|
| 4,280,840 | A | * 7/1981 | Swiecicki | 428/576 |
| 5,989,019 | A | 11/1999 | Nishimura et al. | |
| 6,063,156 | A | 5/2000 | Negami et al. | |
| 6,129,777 | A | 10/2000 | Fuji et al. | |
| 6,149,709 | A | 11/2000 | Uragami et al. | |
| 6,152,983 | A | 11/2000 | Kamijo et al. | |
| 6,214,086 | B1 | * 4/2001 | Montague et al. | 266/195 |
| 6,241,803 | B1 | 6/2001 | Fuji | |
| 6,251,161 | B1 | 6/2001 | Tateishi et al. | |
| 6,254,665 | B1 | 7/2001 | Matsushita et al. | |
| 6,258,149 | B1 | 7/2001 | Sugiyama et al. | |
| 6,296,479 | B1 | 10/2001 | Nishimura et al. | |
| 6,319,302 | B1 | 11/2001 | Harada | |
| 6,334,883 | B1 | 1/2002 | Takenaka et al. | |
| 6,368,379 | B1 | 4/2002 | Tateishi et al. | |

FOREIGN PATENT DOCUMENTS

| | | |
|---|---|---|
| EP | 0 515 744 | 12/1992 |
| JP | 56-163209 | 12/1981 |

* cited by examiner

*Primary Examiner*—Roy King
*Assistant Examiner*—Andrew Wessman
(74) *Attorney, Agent, or Firm*—Oblon, Spivak, McClelland, Maier & Neustadt, P.C.

(57) ABSTRACT

In a method for making molten metal, reduced metal which is produced in a direct reduction furnace is melted in a melting furnace located in the close vicinity of the direct reduction furnace to produce the molten metal. The method includes the steps of putting the reduced metal into a metallic container, and loading the container containing the reduced metal into the melting furnace. The method may further includes, before the step of loading the container containing the reduced metal into the melting furnace, a step of cooling the surface of the container so that the surface temperature of the container is 500° C. or less.

5 Claims, 2 Drawing Sheets

METHOD FOR MAKING MOLTEN METAL

BACKGROUND OF THE INVENTION

1. Field of the Invention

The present invention relates to a method for making molten metal by melting reduced metal which is produced in a direct reduction furnace, wherein melting is performed in a melting furnace located in the close vicinity of the direct reduction furnace. Herein, reduced metal means metal in the form of lumps, powder, or the like containing metallic iron, metallic nickel, metallic chromium, metallic cobalt, or a mixture of these substances obtained by direct reduction of raw materials in the form of lumps, powder, or the like containing, for example, iron oxides, nickel oxide, chromium oxide, cobalt oxide, or a mixture of these substances. Examples of the molten metal include molten pig iron, molten steel, and molten ferroalloys.

2. Description of the Related Art

With respect to making of molten steel, instead of a conventional blast furnace-converter method, a method has been widely used in which a direct reduction furnace and an electric furnace are placed side by side in a mini-mill and reduced iron produced in the direct reduction furnace is immediately melted and smelted in the electric furnace to produce molten steel.

When the reduced iron produced in the direct reduction furnace is transferred to the electric furnace, one of the biggest problems is how to prevent reoxidation. In order to prevent reoxidation during the transfer, either one of the following two methods has been mainly used: (1) a method in which a cooling zone is provided in a direct reduction furnace so that high-temperature reduced iron is sufficiently cooled close to normal temperature by an inert gas before being discharged to the air; and (2) a method in which high-temperature reduced iron produced in a direct reduction furnace is briquetted by high-temperature press molding using a briquetting machine unit, followed by quenching using water. That is, safe transferring is performed by cooling reduced iron close to normal temperature at which the reduced iron is not reoxidized even in the air.

However, in the methods described above, a large cost for equipment is required, and, additionally, since high-temperature reduced iron having a large amount of sensible heat is cooled and is then reheated in an electric furnace to be converted into steel, a great amount of energy is wasted and the power consumption in the electric furnace is large, resulting in a high cost of molten steel.

Therefore, in order to use the sensible heat of high-temperature reduced iron effectively, a proposal has been made in which high-temperature reduced iron is transported, without being cooled, through a closed pipe by a pneumatic transport system to a melting furnace downstream (Japanese Unexamined Patent Application Publication No. 4-361921).

Another proposal has also been made in which high-temperature briquettes (high-temperature reduced iron) discharged from a direct reduction furnace are transported via a traveling grate conveyor and are cooled by circulating an inert gas so as to be in contact with the high-temperature briquettes while the sensible heat of the high-temperature briquettes is recovered, and the recovered energy is used by a heat exchanger to preheat combustion air, a process gas, etc., and heat recovery is performed again by using the inert gas cyclically (Japanese Unexamined Patent Application Publication No. 56-163209).

However, with respect to the proposals described above, the cost of equipment is increased because of complex facilities, and the operating cost is also increased because of the electric power of boosters for circulating the gas for the pneumatic transport system and the inert gas. As a result, it is not possible to take full advantage of the utilization of the sensible heat of the high-temperature reduced iron, and the costs for the reduced iron are still high.

On the other hand, in order to effectively use waste and the like generated in steel mills, an attempt has been made, in which the waste and the like containing iron oxides, nickel oxide, chromium oxide, cobalt oxide, or a mixture of these substances, to which a carbonaceous material is added as necessary, is agglomerated, and the resultant agglomerates are reduced by heating in a rotary hearth direct reduction furnace to produce reduced metal, and then the reduced metal is melted in a melting furnace, such as an electric furnace or a converter, to recover the metallic portion. Such a process has been employed by many steel mills. The amount of reduced iron produced by this process is often relatively small compared to the amount of reduced iron produced by the conventional direct reduction furnace. Therefore, it is not possible to employ the method of effectively using the sensible heat of reduced metal by the pneumatic transport system or the circulation of the inert gas because the cost of equipment for unit production volume of the reduced metal is excessive in relation to the cost-saving effect by the recovery of sensible heat. Under these circumstances, a plurality of heat-resistant containers are prepared, and a predetermined amount of high-temperature reduced metal is put in each container. The containers containing the high-temperature reduced metal are transported to a melting furnace in sequence and the reduced metal is loaded into the melting furnace. The empty containers are brought back to the direct reduction furnace to be reused. Moreover, in order to save on the cost of equipment, the containers are often manually transported using forklifts and cranes.

As the heat-resistant container, which must retain heavy and high-temperature reduced iron for a long period and must withstand handling during transportation, a steel container with refractory lining, a thick steel sheet provided with a cooling fin and a stiffening rib, or the like is used. Consequently, the cost of the container is high, handling of the container is not easy due to the large weight of the container, and the costs of maintenance against the abrasion of the refractory lining, the steel sheet, etc., are also high.

Furthermore, a complex operation, such as reversing of the container to load the reduced metal into the melting furnace, or a complex structure, such as a container in which the bottom is constructed so as to be opened and closed is required.

Although it depends on the direct reduction process to be employed, at least approximately 2 to 3 percent by mass of reduced metal powder is contained in the reduced metal due to generation of powder when the direct reduction furnace is loaded with the raw material and within the direct reduction furnace. The melting yield may be decreased and the working environment may be degraded due to flying of the powder when the reduced metal is loaded into the melting furnace.

SUMMARY OF THE INVENTION

It is an object of the present invention to provide a method for making molten metal with low cost, in which expensive facilities are not required, the melting yield is not decreased, or the working environment is not degraded.

In a method for making molten metal according to the present invention, wherein reduced metal which is produced in a direct reduction furnace is melted in a melting furnace located in the close vicinity of the direct reduction furnace to produce the molten metal, the method includes the steps of putting the reduced metal into a metallic container, and loading the container containing the reduced metal into the melting furnace.

In the method for making molten metal, preferably, the container is a steel drum.

Preferably, the method for making molten metal further includes, before the step of loading the container containing the reduced metal into the melting furnace, a step of cooling the surface of the container so that the surface temperature of the container is 500° C. or less.

Preferably, the method for making molten metal further includes, before the step of putting the reduced metal into the container, a step of cooling the reduced metal to 500° C. or less.

In accordance with the present invention, since reduced metal which is produced in a direct reduction furnace is put into a metallic container while retaining the high temperature of the reduced metal, and the container containing the reduced metal is loaded into a melting furnace, the container is not required to be heat-resistant and strong enough to be used for a long period of time, and a metallic container having a simple structure with a relatively small thickness can be used. Consequently, since the weight of the container is decreased and a complex operation, such as reversing the container at the melting furnace, is not required, the handling load is significantly decreased. The maintenance against the abrasion of the refractory lining, the steel sheet, etc., is not required. That is, melting can be performed by simple facilities while retaining the sensible heat of the reduced metal in the melting furnace, resulting in a reduction in cost. Additionally, since the container containing the reduced metal is loaded into the melting furnace, powder is prevented from flying, thus improving the melting yield and maintaining the satisfactory working environment. Additionally, since the container itself is used as the raw material for melting, the melting yield is further improved.

If a steel drum is used as the metallic container, the cost of the container can be saved. In particular, if a waste drum is used, the cost of the container is not substantially required, and the waste drum, which is currently disposed of as it is, can be reused. Thus, the production cost of molten metal is further decreased.

That is, if a waste drum is loaded into a melting furnace as it is, it floats in molten metal with the majority of the waste drum being not immersed in the molten metal because of its hollowness. As a result, the melting efficiency of the waste drum is significantly lower than the melting efficiency of usual scraps. Additionally, since the steel drum is usually composed of a thick steel sheet so as to withstand handling during transportation and to resist corrosion due to long-term storage, it is difficult to decrease the volume by crushing with a commonly used press.

Therefore, in order to reuse the steel drum, for example, a system of reusing a steel drum disclosed in Japanese Unexamined Patent Application Publication No. 10-57928 may be used, in which, after a steel drum is crushed into scraps with a four axial shredder, the coating material, etc., is burnt and removed by heating in a rotary kiln, and the scraps are then pelletized by a pelletizer. However, use of this system has not been implemented because of high cost of equipment in conjunction with many steps involved.

In contrast, in the present invention, since the waste drum containing reduced metal is loaded into the melting furnace, melting proceeds with a considerable portion of the whole waste drum being immersed in molten metal, and thereby a high melting efficiency is achieved.

Furthermore, by cooling the surface of the container to 500° C. or less, the strength of the metallic container is not substantially decreased, and the container is not deformed when it is transported to the melting furnace. Even when the surface of the container is coated, the coating material is not volatilized or burnt, thus further improving the working efficiency and environment.

Alternatively, instead of cooling the surface of the container, by cooling the reduced metal to 500° C. or less, obviously the same effect is displayed.

DESCRIPTION OF THE PREFERRED EMBODIMENTS

The embodiments of the present invention will now be described with reference to the drawings.

Figure 1:
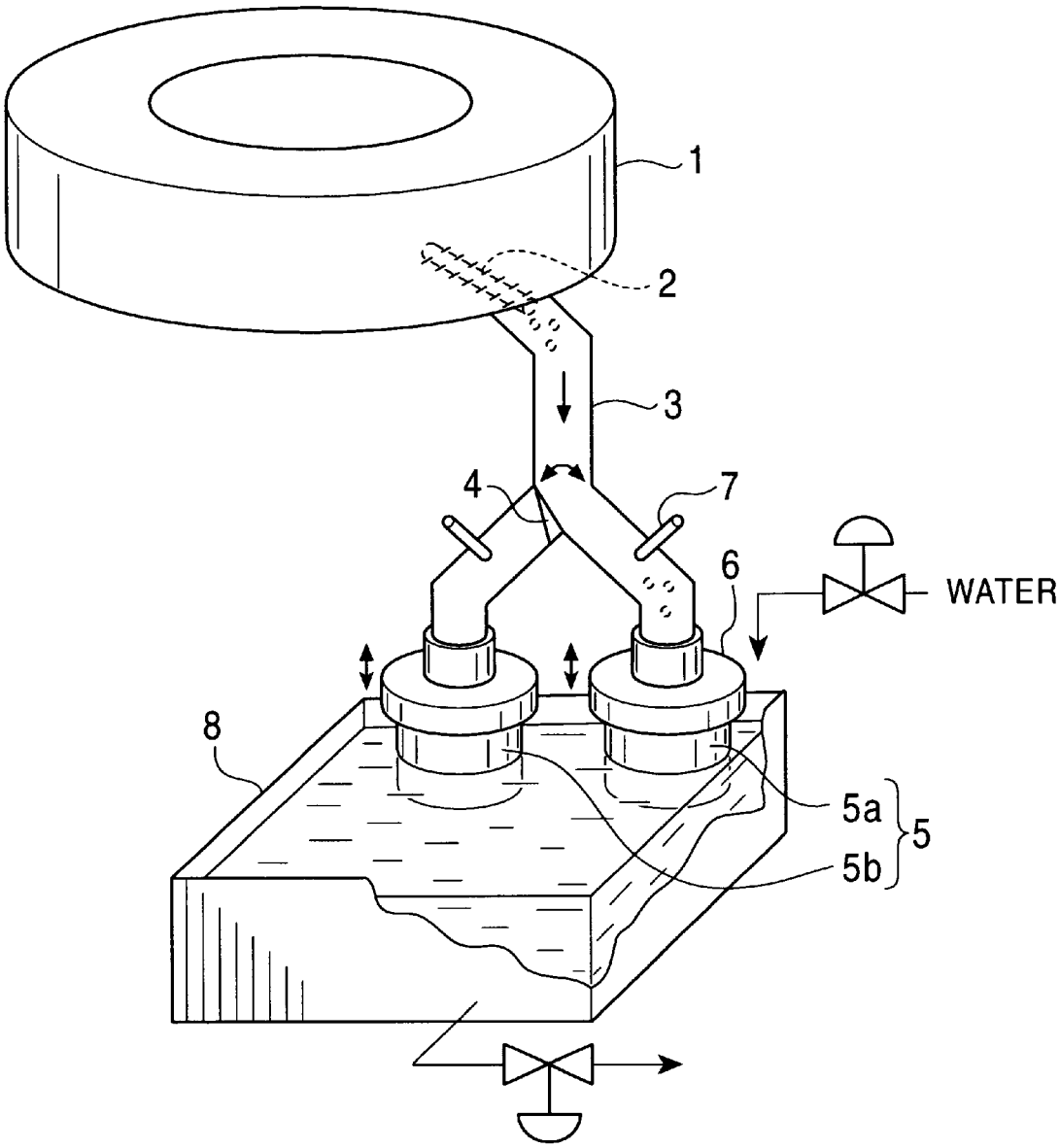
FIG. 1 is a schematic diagram showing a mechanism for putting reduced metal into metallic containers in an embodiment of the present invention.

FIG. 1 is a schematic diagram showing a mechanism for putting reduced metal into metallic containers in an embodiment of the present invention. As shown in FIG. 1, a rotary hearth furnace 1 is used as a direct reduction furnace. Metal reduced in the rotary hearth furnace 1 is discharged by a discharger 2 at approximately 800 to 1,000° C. and is put into steel drums 5 as metallic containers via a chute 3. Additionally, the direct reduction furnace is not limited to a rotary hearth furnace and may be a shaft furnace, a rotary kiln, a fluidized bed furnace, or the like.

The chute 3, for example, bifurcates in the lower part, and a diverter 4 for selecting the passage of the reduced metal is provided at the bifurcation point. Steel drums 5*a* and 5*b* are connected to the respective lower ends of the bifurcate chute 3. The diverter 4 is set so that the reduced metal is put into the drum 5*a* only. When the drum 5*a* is filled with the reduced metal in the predetermined weight or more, the diverter 4 is switched to the opposite side, and the reduced metal is put into the drum 5*b* while the filled drum 5*a* is replaced with another empty drum. In this way, even when the drums 5 are replaced, the reduced metal can be discharged from the rotary hearth furnace 1 continuously.

A movable sealing device 6 may be provided on the lower end of the chute 3. Preferably, the movable sealing device 6 is lowered to seal the upper parts of the drums 5 so that the outside air is kept out where the reduced metal is put into the drum. Gas sealing is not always perfect because powder of the reduced metal or the like interferes between the diverter 4 and the chute 3. Therefore, preferably, a damper 7 is provided on each bifurcation of the chute 3 so that the outside air is prevented from entering the reduction furnace 1 from the lower ends of the chute 3 when the drums 5 are replaced. Furthermore, preferably, a small amount of an inert gas or reducing gas is injected into the chute 3 and the drums 5 to provide a positive pressure so that the outside air is prevented from entering.

In order to facilitate handling of the drums 5 detached from the chute 3 and to prevent the coating material from being volatilized or burnt, preferably the surfaces of the drums 5 are cooled to 500° C. or less. In order to cool the surfaces of the drums 5 to 500° C. or less, for example, as shown in FIG. 1, at least lower parts of the drums 5 are immersed in cooling water circulating in a cooling water pool 8. By changing the flow of cooling water and the water level (the area of the surfaces of the drums 5 immersed in water), the surface temperatures of the drums 5 can be adjusted. Alternatively, water may be directly sprayed or air may be injected onto the surfaces of the drums 5, which may be combined with the immersing method described above.

The drums 5 detached from the lower ends of the chute 3 are covered with lids immediately so that the reduced metal is not reoxidized. The drums 5 are then transported to a melting furnace, such as an electric furnace or converter (not shown in the drawing), appropriately using a transport device, such as a forklift, crane, lifting magnet, or charging pan (not shown in the drawing). There may be cases where the drums 5 are not completely covered with the lids because of the thermal expansion of the drums 5 or the drums 5 are not completely covered with the lids because the drums 5 are waste and the drum bodies and the lids are deformed or rusted. In such cases, for example, the drums 5 may be transported after the bodies and the lids are fastened together with steel bands (bolted rings) so that the lids are not removed.

The drums 5 covered with the lids are loaded into a melting furnace. As described above, melting proceeds with a considerable portion of the whole waste drum being immersed in molten metal, and when parts of the drums 5 are completely melted and openings are formed, the reduced metal inside the drums is brought into contact with the molten metal and starts to be melted. Although it depends on the direct reduction process used or operating conditions, reduced metal usually contains at least 1 to 2 percent by mass of C and a small amount of unreduced FeO. Therefore, when the reduced metal is melted, CO gas is generated by the reaction $FeO+C \rightarrow Fe+CO$, and melting is accelerated by the bubbling effect of the CO gas. Preferably, a carbonaceous material is added into the molten metal as necessary because the carbonaceous material has the similar melting-accelerating effect.

Even when the drums 5 are coated, since the drums 5 are heated to 500 to 600° C. or more as soon as they are loaded into the melting furnace, the coating material is volatilized or burnt to be removed into exhaust gas, and thus the composition of the molten metal is not adversely affected.

Additionally, although the drums 5 may contain various alloy components depending on the originally intended use, since the total weight of the drums are small relative to the total weight of the reduced metal to be loaded into the melting furnace, the composition of the molten metal is not substantially affected.

Figure 2:
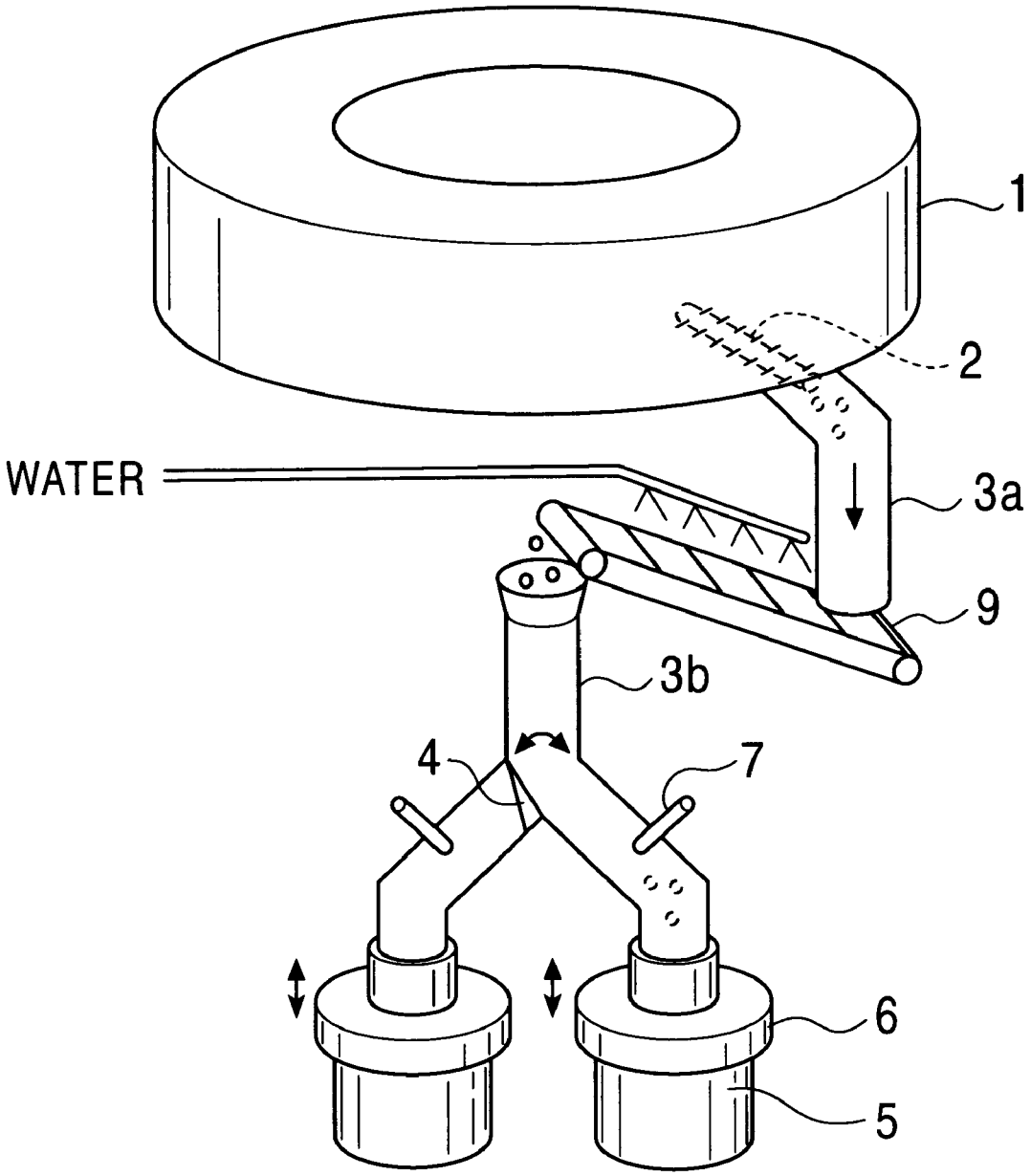
FIG. 2 is a schematic diagram showing a mechanism for putting reduced metal into containers in another embodiment of the present invention.

FIG. 2 is a schematic diagram showing a mechanism for putting reduced metal into metallic containers in another embodiment of the present invention. As shown in FIG. 2, metal reduced in a rotary hearth furnace 1 which is a direct reduction furnace is discharged by a discharger 2 at approximately 800 to 1,000° C., and is, via a chute 3*a*, placed on a conveyor made of steel (quench conveyor) 9 which cycles continuously. The reduced metal on the conveyor is cooled by water spray to 500° C. or less, and is then put into metallic containers, for example, steel drums 5. Although the surface of the reduced metal is reoxidized during cooling by water spray, reoxidation does not advance to the inside of the drums because of the oxide layers, resulting in just a small reoxidation rate. In order to prevent water from adhering to the surface of the reduced metal and the inner surfaces of open pores of the reduced metal, the temperature of the reduced metal after cooling by water spray is preferably set at 100° C. or more. The reason for this is that, if adherent water is brought into the melting furnace, energy loss occurs because of the heat of vaporization of the adherent water.

A chute 3*b* having the same bifurcate structure as that of the chute 3 shown in FIG. 1 may be disposed in the close vicinity of the outlet of the quench conveyor 9 so that the reduced metal can be continuously discharged when the drums 5 are replaced.

What is claimed is:

1. A method for making molten metal, wherein reduced metal produced in a direct reduction furnace is melted in a melting furnace in the close vicinity of the direct reduction furnace, the method comprising the steps of:

putting the reduced metal into a metallic container;

loading the container containing the reduced metal into the melting furnace; and before the step of loading the container containing the reduced metal into the melting furnace, a step of cooling the surface of the container to 500° C. or less.

2. The method for making molten metal according to claim 1, wherein the container is a steel drum.

3. The method for making molten metal according to claim 2, further comprising, before the step of loading the container containing the reduced metal into the melting furnace, a step of cooling the surface of the container to 500° C. or less.

4. The method for making molten metal according to claim 2, further comprising, before the step of putting the reduced metal into the container, a step of cooling the reduced metal to 500° C. or less.

5. A method for making molten metal, wherein reduced metal produced in a direct reduction furnace is melted in a melting furnace in the close vicinity of the direct reduction furnace, the method comprising the steps of:

putting the reduced metal into a metallic container;

loading the container containing the reduced metal into the melting furnace; and before the step of putting the reduced metal into the container, a step of cooling the reduced metal to between 100 and 500° C.

* * * * *